US005890548A

United States Patent [19]

Juvonen

[11] Patent Number: 5,890,548

[45] Date of Patent: Apr. 6, 1999

[54] HYDRAULIC PERCUSSION HAMMER

[75] Inventor: Esko Juvonen, Lahti, Finland

[73] Assignee: Bretec Oy, Lahti, Finland

[21] Appl. No.: 671,129

[22] Filed: Jun. 24, 1996

[30] Foreign Application Priority Data

Jul. 6, 1995 [FI] Finland ..... 953337

[51] Int. Cl.[6] ..... B25D 9/26

[52] U.S. Cl. ..... 173/208; 173/128; 173/138; 91/300; 91/321

[58] Field of Search ..... 173/206, 207, 173/208, 128, 135, 138, 17, 137; 91/300, 303, 290, 321

[56] References Cited

U.S. PATENT DOCUMENTS

| | | | |
|---|---|---|---|
| 3,759,335 | 9/1973 | Coyne | 173/207 |
| 4,460,051 | 7/1984 | Widmer | 173/208 |
| 4,474,248 | 10/1984 | Musso | 173/208 |
| 4,817,737 | 4/1989 | Hamada et al. | 173/207 |
| 4,899,836 | 2/1990 | Venot | 173/207 |
| 5,392,865 | 2/1995 | Piras | 173/207 |
| 5,653,295 | 8/1997 | Juvonen et al. | 173/208 |

FOREIGN PATENT DOCUMENTS

| | | |
|---|---|---|
| 0 214 064 | 3/1987 | European Pat. Off. . |
| 0 256 955 | 2/1988 | European Pat. Off. . |
| 0 472 982 | 3/1992 | European Pat. Off. . |
| 0 688 636 | 12/1995 | European Pat. Off. . |
| 50390 | 12/1975 | Finland . |
| 2852/74 | 11/1977 | Finland . |
| 760672 | 4/1982 | Finland . |
| 72908 | 4/1987 | Finland . |
| 86762 | 6/1992 | Finland . |
| 922483 | 12/1992 | Finland . |
| 943074 | 6/1994 | Finland . |
| 92477 | 8/1994 | Finland . |
| 2004864 | 12/1969 | France . |
| 2375008 | 7/1978 | France . |

*Primary Examiner*—Scott A. Smith
*Attorney, Agent, or Firm*—Smith-Hill and Bedell

[57] ABSTRACT

Hydraulic percussion hammer, in which a motion of a percussion piston (1) is controlled by a main valve (3), the control motion of which is controlled by a separate control valve (9) in such a way that the main valve changes its state, when the pressure acting on the control valve (9) rises to a predetermined value. The percussion hammer comprises a controller (21) mounted in its return duct (13), by which controller an outflow of pressure fluid from the percussion hammer can be adjusted in such a way that the filling rate of a pressure accumulator (7) and thus the length of a return motion of the percussion piston (1) are proportional to the flow resistance provided by the controller (21).

7 Claims, 3 Drawing Sheets

HYDRAULIC PERCUSSION HAMMER

Figure 1:
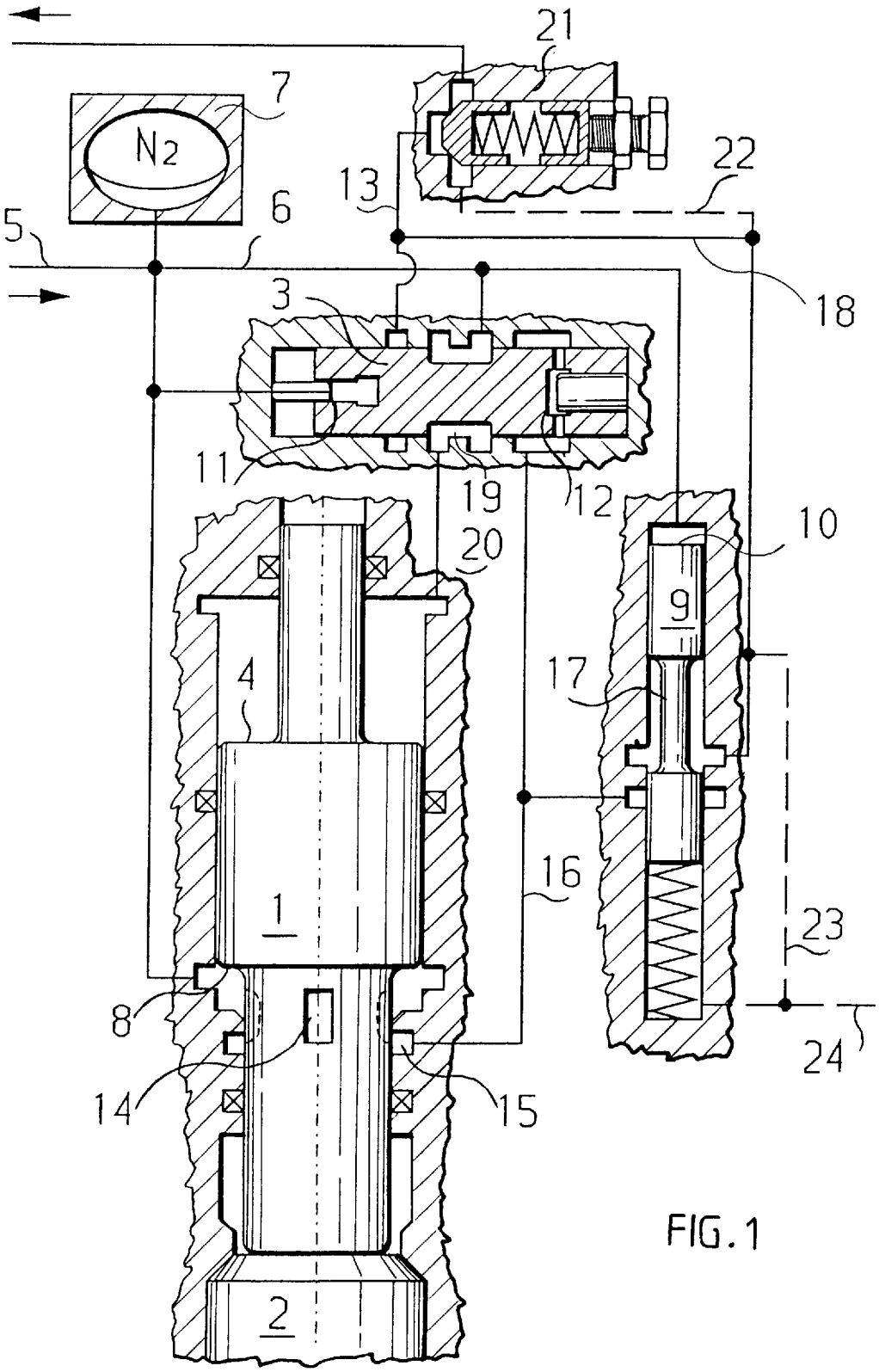

The invention relates to a hydraulic percussion hammer, comprising a percussion piston having two pressure surfaces, a pressure accumulator, an inlet duct for supplying the percussion hammer with pressure fluid, a return duct for leading the pressure fluid out of the percussion hammer, a main valve connected to guide a high pressure and a low pressure to act alternately at least on one pressure surface of the percussion hammer for reciprocating the percussion piston for an impact and a control pressure valve being in contact with the inlet duct, driven by the pressure therein and connected to control the main valve during a return motion of the percussion piston in such a way that it allows an access of the control pressure to the main valve when the pressure acting on the control pressure valve exceeds a predetermined value.

In general, hammers are mounted in diggers as an auxiliary equipment instead of a dredger ladle, but other basic machines or carriers can also be used. The hammers thus operate by the hydraulics of the basic machine. An output power ($P_2$) of hydraulically operating percussion hammers depends mainly on the impact energy (W) of the hammer and on the number of strokes (z), i.e. $P_u$=W*z. Such hammers are generally used for breaking relatively hard materials, such as stones, concrete, frozen asphalt, metallurgic slag etc.

The breaking capability of the hammer depends, except on the output power, on the properties of the material to be broken, on the shape and dimensions, such as thickness and length, of a blade or a tool, but also on the pressing force, which signifies the force by which the whole hammer is pressed against the blade and further against the material to be broken. The breakage is caused by the blade penetrating the material or by the material fracturing on account of a compressive tensile stress wave caused by an impact. At breakage, an innumerable amount of different combinations of these mechanisms occur, naturally.

In order to be able to use the hammer preferably in as many different diggers or other basic machines as possible, the hammers are typically provided with pressure or impact parameter control devices to keep the performance characteristics of the hammer within the limits desired by the manufacturer. Such control devices are disclosed e.g. in the Finnish Patents 50390 and 92477 and in the Finnish Patent Application 760672. However, the problem with these is, especially in hiring, the necessity of readjusting the hammer each time when mounted on another digger. The Finnish Patent 92477 discloses a method of adjusting impact parameters as a function of ground hardness, which has been provided by means of many spring-loaded valves and throttles, which leads to lots of adjustable objects when the hammer is displaced from one digger to another.

The Finnish Patent Application 943074 discloses a device, by which the hammer can be caused to operate preferably in different diggers without the need to re-adjust the hammer when it is displaced from one digger to another. There are drawbacks also in this arrangement, such as changed impact power, if only the impact energy shall be adjusted, which is due to the fact that the length of stroke of the percussion hammer does not change significantly. Another drawback of the arrangement of the Patent Application 943074 is the remote control line required for the power control, which line demands an extra pipe or hose for the digger. To construct an extra line e.g. in hiring causes problems.

The object of this invention is to provide a percussion hammer by which the drawbacks of the earlier solutions can be avoided. The percussion hammer according to the invention is characterized in that it comprises a controller mounted in the return duct of the pressure fluid, by which controller the outflow of the pressure fluid from the percussion hammer can be adjusted, whereby the filling rate of the pressure accumulator and thus the length of the return motion of the percussion piston are proportional to the flow resistance provided by the controller.

According to this invention, the hammer is adjusted by two pressure controllers simultaneously, one of them operating in accordance with the Finnish Patent Application 943074 and the other one being a return flow resistance valve. A motion of the main valve is controlled for a motion of the percussion piston in the impact direction by the control pressure valve and for a return motion according to the position of the percussion piston. The operation of the control pressure valve is independent of the position of the percussion piston, for which reason the length of stroke of the percussion piston is adjusted by means of the flow resistance of the hammer. The flow resistance changes because of the properties of the material to be broken or it can be adjusted by changing the return flow resistance. The impact energy of the hammer depends thus on the adjusted value of the control pressure valve as well as on the length of stroke of the percussion piston, which length is influenced by adjusting the flow resistance of the hammer in the manner described above.

When the flow resistance of the hammer is small, the percussion piston moves the maximum length of stroke in the return direction and stops in the rear position to wait for that the accumulator has been charged to a predetermined value adjusted by the control pressure valve. After the predetermined value has been achieved, the percussion piston carries out a full-length stroke motion and provides the blade with the maximum impact energy. If the flow resistance is increased by increasing the volume flow fed into the hammer, by increasing the return flow resistance or by striking a more easily penetrated material, the length of stroke of the percussion piston shortens, and then the impact energy decreases, but the stroke frequency increases, correspondingly.

The control pressure valve can be adjusted during hammering only by means of remote control devices, but the return flow resistance can be adjusted by throttling or pressure control devices, which can be positioned inside the hammer or anywhere else in the return line between the hammer and a pressure vessel. When the return flow resistance valve is positioned in the vicinity of the pressure fluid vessel or the valve systems of the basic machine, only normal hydraulic lines, i.e. an outlet and return line, and no special control line, are required for a remote-controlled hammer according to the invention.

Figure 2:
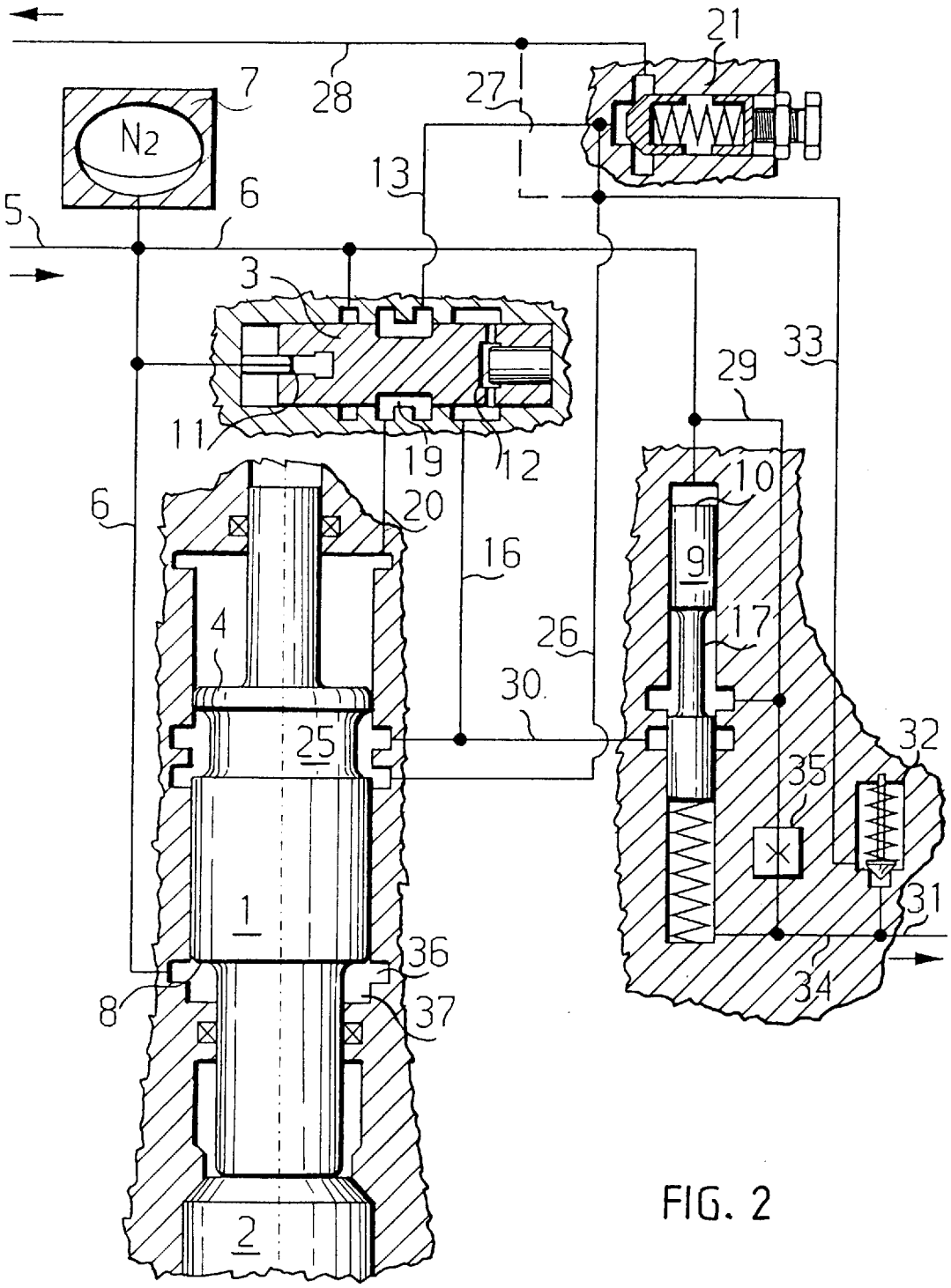
Figure 3:
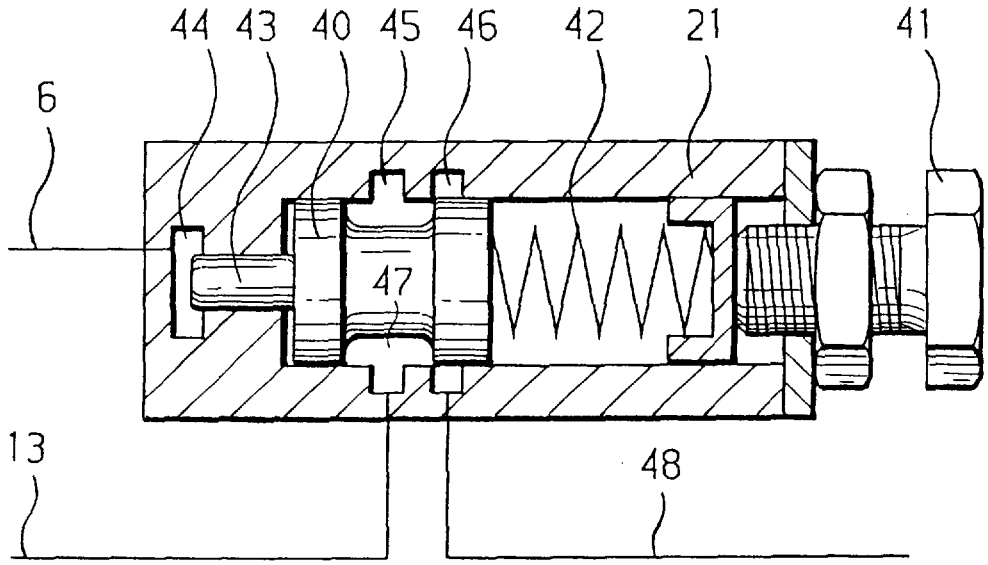

The invention will be described in greater detail in the following with reference to the attached drawings, in which FIG. 1 shows schematically an embodiment of a percussion hammer according to the invention, FIG. 2 shows schematically another embodiment of the percussion hammer according to the invention and FIG. 3 shows schematically a resistance valve of a return line of pressure fluid, which valve is suitable for the implementation of the percussion hammer according to the invention.

FIG. 1 shows a hammer according to the invention, comprising a percussion piston 1 in an impact position against a blade 2. A main valve 3 is still in a position in which the inlet flow of the hammer and a high pressure can affect a variable-pressure annular space above the percussion hammer and a pressure surface 4 of the percussion piston. Pressure fluid flows in through an inlet duct 5 into a high-pressure duct 6, which is in continuous contact with a pressure accumulator 7 and an annular space below the percussion piston and a pressure surface 8 of the percussion piston, which surface is considerably smaller than the upper pressure surface 4, and further in continuous contact with a pressure space of a control pressure valve 9 and a pressure surface 10 of a spindle.

The main valve 3 is controlled by two opposite pressure surfaces 11 and 12, one surface 11 of which is smaller and always in contact with the high-pressure duct 6. The larger pressure surface is guided into the high-pressure duct 6 and a return duct 13, alternatively.

According to the invention, when the percussion piston is in the impact position, it establishes a high-pressure connection by means of its groove 14 to a groove 15 and to a control pressure duct 16, and further, to affect the pressure surface 12. When the percussion piston is in the rear position, it changes its direction of motion from the return motion to the impact direction. The distance between the rear position and the blade is the length of stroke of the percussion piston. When the percussion piston is in the rear position, the control pressure valve 9 establishes a connection by means of its groove 17 from the control pressure duct 16 to a duct 18, which leads to the return duct 13. It is obvious that the main valve can be made to operate by means of advantageous dimensioning also inversely, as shown in FIG. 2, i.e. with the percussion piston in the impact position, the pressure space 12 is connected to the return line, and in the rear position to the high-pressure line.

Depending on the pressure level affecting the pressure surface 12, the main valve 3 moves to the left or to the right, always to its extreme position. When a high pressure is acting on the pressure surface 12, the main valve 3 moves to a position in which a groove 19 connects a duct 20 from the pressure space above the percussion piston to the return duct 13. In FIG. 1, the percussion piston has just opened a high-pressure connection to the pressure surface 12 and the main valve 3 is starting its motion in order to open a connection from the space of the pressure surface 4 of the percussion piston to the return duct 13. With the percussion piston in the rear position, a connection is established from the pressure surface 12 to the return line by means of the control pressure valve 9, whereby the groove 19 of the main valve connects the high-pressure duct 6 to the space of the pressure surface 4 above the percussion piston through the duct 20.

In the return duct 13 is positioned according to the invention a resistance valve 21, which can be a spring-loaded non-return valve or a pressure relief valve, as well as a flow-control valve or a combination of the above-mentioned. Such a valve can naturally also be pilot-controlled.

The operation of the device according to the invention will be described in greater detail in the following.

When the hammer is started, pressure fluid flows through the high-pressure duct 6 to the accumulator 7 and to the lower pressure space 8 of the percussion piston. When the percussion piston has arrived at its rear position, it remains waiting for a pressure rise in the accumulator 7 caused by decreasing gas volume. When the pressure of the high-pressure circuit on the pressure surface 10 of the control pressure valve 9 exceeds the value adjusted by spring force from the opposite side of the spindle, the groove 17 opens a connection from the pressure space 12 of the main valve to the return ducts 18 and 13. The main valve 3 changes its position and connects the high-pressure circuit to the pressure space 4 above the percussion piston. Because the pressure surface 4 above the percussion piston is larger than the lower pressure surface 8, a force accelerating the percussion piston in the impact direction is generated under the influence of the high pressure. The velocity of the percussion piston grows so high that the inlet flow is not capable of filling the upper pressure surface space 4, but the accumulator 7 discharges pressure fluid also into the high-pressure duct 6 and into the upper pressure surface 4 space. When the gas space of the accumulator increases, the pressure therein and the pressure in the whole high-pressure circuit fall, due to which the groove 17 of the control pressure valve 9 closes the connection between the control pressure duct 16 and the return duct 18. When the percussion piston strikes the upper end of the blade, its velocity decreases abruptly even down to zero, depending on the penetration resistance of the blade into the material to be broken. Penetration occurs, if the material is soft or brittle, in which case the material to be broken is crushed under the blade. If penetration does not take place in a sufficient degree, a great part of the impact energy is reflected as a compressive and tensile stress wave back to the impact end of the percussion piston and generates a great force accelerating the percussion piston in the return direction. The flow resistance of the hammer consists in a known manner of the flow resistance of pressure fluid in the ducts and through the valves as well as of the return line flow resistance, but also of acceleration resistances of the masses to be moved by means of pressure fluid, such as the percussion piston and the main valve, and of friction. The share of the friction is slight, but an even mutual synchronization between the percussion piston and the main valve is important for the minimum flow resistance. The maximum flow resistance consists, of course, of the return flow resistance and the acceleration resistance of the mass of the percussion piston. The acceleration resistance of the mass of the percussion piston in the return direction varies according to the material to be broken. As explained above, a great force accelerating the percussion piston in the return direction is generated in a non-penetrated material, which force is directed to the percussion piston by means of the blade from outside the hammer, whereby the flow resistance of the hammer is small. If the blade penetrates the material to be broken, the force in question remains small, even zero, which causes a high resistance against the flow of the pressure fluid through the hammer, because the mass of the percussion piston is then accelerated in the return direction by means of the pressure of the pressure fluid.

During the return motion of the piston, the accumulator 7 is charged and the pressure of the high-pressure circuit rises. The charging rate of the accumulator depends on the volume flow fed into the hammer and on the flow resistance of the hammer. At a high flow resistance, the accumulator is thus charged faster than at a low flow resistance. According to the invention, no restrictions or steps have been set for the length of stroke of the percussion piston except for the maximum length, but the rear position of the percussion piston is dependent on the filling rate of the high-pressure accumulator only. Then the length of stroke of the hammer shortens steplessly when the flow resistance increases and the length of stroke grows up to the maximum length when the flow resistance decreases.

The influence of the flow resistances on the length of stroke of the percussion piston depends on the size of the lower pressure surface 8 of the percussion piston in proportion to the upper pressure surface 4. If the proportion is too large, the percussion piston moves too easily in the return direction and a lot of flow resistance is required in the return line, in addition to which the influence of the material to be broken decreases. In accordance with theoretical calculations and practical measurements, the device according to the invention operates most advantageously, if the lower pressure surface 8 is smaller than one fourth of the upper pressure surface 4.

According to the invention, the flow resistances of the hammer in the return line and the acceleration resistance of the percussion piston in the return direction are simultaneous additive resistances, i.e. so-called series resistances, which determine the length of stroke of the percussion piston together with the filling resistance of the parallel pressure accumulator and the fed volume flow. Accordingly, at low volume flows and small return line resistances, no such control is generated at all which depends on the properties of the material. By increasing then the return line resistance, it is possible to make the control start without changing the power of the hammer, but if, instead of increasing the return resistance, the opening pressure of the control pressure valve is reduced, it is also possible to make the control start, but in that case, the power of the hammer has also decreased. In hiring, it is preferable to position the resistance valve of the return line in the hammer and to adjust it to provide at a predetermined volume flow a desired additional impact frequency when going over from a hard non-penetrated material to a soft or brittle easily-penetrated material.

When the device according to the invention is compared with the prior art devices disclosed in the Finnish Patents 86762 and 92477, in which impact parameters are adjusted on the basis of the material to be broken, it can be stated that the device of the present invention does not comprise devices for adjusting impact parameters to be adjusted on the basis of a comparison of time or pressure changes in the vicinity of the impact position. The operation of the control pressure valve does not change significantly during the adjustment, since the spindle amplitude decreases, though the stroke frequency increases, which decrease does not affect the opening of the spindle in the rear position of the percussion piston. The resistance valve of the return line does not change its adjusted values either, but it is adjusted to provide a predetermined counter-pressure at a predetermined volume flow. On the basis of the material properties, only the length of stroke of the percussion piston is then changed, which finally influences the impact parameters, such as the velocity of the percussion piston at the impact moment and the stroke frequency. As to the device of the invention, a big difference is also the maximum length of stroke of the percussion piston at the first stroke when the hammer is started. After the start, said hammers adjustable on the basis of the material to be broken begin with a short length of stroke or at a low pressure level, which causes an underpowered impact on hard stone and thus generates a damping sand bed between the material to be broken and the blade, because the devices for adjusting impact parameters take into account values of a plurality of successive impacts with reference values. The damping sand bed reduces the strength of strokes and thus feeds values of soft stone to the adjusting devices, even if a high impact energy were required for breaking the stone.

The properties of the device according to the invention can be changed by closing the duct 18 to the control pressure valve and by opening a duct 22, in which case the return flow pressure increased by the return flow resistance valve does not affect the control pressure surface 12 of the main valve.

The adjusted value of the control pressure valve can also be influenced by combining the spring space by means of a duct 23 with the return duct 13 of the hammer (FIG. 1 shows the connection through the duct 18). Then the pressure increased by the return flow resistance valve has an increasing effect also on the operating pressure of the hammer. Therefore, one embodiment of this invention is to dimension the hammer in such a way that, with increasing return flow resistance and with shortening length of stroke, the operating pressure of the hammer increases in such a way that the impact energy remains constant. Such a hammer is very usable when it is mounted on diggers of different kinds, in which the size of hammer lines, the pressure level of hydraulic pumps etc. may vary within wide limits.

A duct 24 represents a remote control line according to the Finnish Patent Application 943074.

FIG. 2 shows a device according to the invention, in which a groove 25 in the middle area of the percussion piston 1 combines the pressure space 12 of the main valve 3 through the duct 16 with a duct 26, which leads to the return duct 13, or alternatively, through a duct 27 marked with broken lines to a return duct 28. The connection achieved through the groove 25 depends on the position of the percussion piston and it is arranged to open when the percussion piston strikes the blade 2. An advance compensating for the slowness of the main valve and not described more accurately here is dimensioned for the opening of the connection in a normal manner. With the percussion piston in the rear position, the control pressure surface 12 of the main valve 3 is connected to the high-pressure circuit by means of the groove 17 of the control pressure valve 9 through ducts 29, 30 and 16. The connection opens in the manner described above when the pressure of the pressure accumulator 7 rises so that the force generated at the pressure surface 10 overcomes spring forces and other adjusting forces affecting the spindle.

The adjusted value of the control pressure valve can be affected by spring force and by means of a remote control line 31. FIG. 2 shows also a maximum pressure valve 32 according to the Finnish Patent Application 943074, by which valve the spring space can be connected to the return line through ducts 33 and 13 or 33 and 27, alternatively. For an adjustment of the control pressure valve 9, a control line 34 is connected to the high-pressure duct 6 and 29 through a throttle 35.

FIG. 2 shows also a braking of the percussion piston in the impact direction, which is necessary when the blade 2 moves in the impact direction so far that the percussion piston 1 does not reach it without striking the bottom of the lower pressure space. For the braking, a groove 36 in contact with the high-pressure duct 6 is separated from the lower pressure surface 8 by means of a chamber 37, in which the pressure for braking the motion energy of the percussion piston rises so high that the percussion piston stops. The groove 25 is dimensioned to keep open between the ducts 16 and 26.

The device according to the invention operates preferably in a situation of braking an idle stroke, which situation arises when the pressing force of the hammer is too small or the blade penetrates the material to be broken so deep that the percussion piston does not reach it, as e.g. when a stone cracks abruptly under the blade. According to the invention, when the percussion piston continues its motion past the impact point into the brake, the acceleration resistance of the return motion of the percussion piston mass becomes so great that the pressure of the pressure accumulator 7 rises so high that the control pressure valve remains open during the next stroke or, at great volume flows, the percussion piston does not even rise from the brake when the control pressure valve has opened already. This property can be influenced especially by the depth of the damping chamber 37 in the impact direction and by the diameter play of the space with regard to the percussion piston. When the groove 17 of the control pressure valve and the groove 25 (in FIG. 2) or 14 (in FIG. 1) of the percussion piston are simultaneously open into the control pressure duct 16, a free flow circuit is generated in the hammer from the high-pressure duct 6 to the return duct 13, whereby the volume flow fed into the hammer flows through the hammer without moving the precussion piston. The flow takes place through the ducts 6, 29, 30, 16, 26 and 13 (FIG. 2) or 6, 14, 16, 18 and 13 (FIG. 1). Then the operation of the hammer stops without the pressure relief valve, a so-called safety valve, opening in the hydraulic circuit of the hammer line.

This is very useful since safety valves are often positioned, because of pulsating pressure, even 50 bar higher than the desired operating pressure of the hammer, in addition to which an often operating safety valve wears rapidly.

A possible way of working with the hammer according to the invention is also that the operating valve of the hammer line is kept open and the hammer starts always upon pressing the hammer against an object to be broken.

The hammer according to the invention operates in the same way when oversized volume flows are fed into the hammer, whereby the percussion piston shortens the length of stroke when the pressure level rises, until the groove 25 or 14 of the percussion piston is open simultaneously with the groove 17 of the control pressure valve, causing a free circulation through the hammer without the pressure relief valve of the hammer line opening.

FIG. 3 shows a return flow resistance valve 21 of a device according to the invention, which valve opens only by means of high pressure. As to the other parts, the hammer conforms to FIG. 1 or 2. The return duct 13 of the valve leads to a groove 45, a groove 47 in a spindle 40 is arranged on the basis of the position of the spindle to open and close the connection from said groove 45 to another groove 46, from which a duct 48 leads the return flow further to the hydraulic aggregate of the basic machine. The high-pressure duct 6 is in continuous contact with a pressure space 44 comprising a pin 43. When high pressure is acting on the end of the pin 43, a force is generated in the spindle 40, which force tries to open a connection between the grooves 45 and 46. The opening force is resisted by the spring force of a spring 42, adjustable by a screw 41. It is natural that the spring force can be replaced by another hydraulic power, by the force of an electromagnet or by combinations of these.

The device of the invention provided with the return duct resistance valve 21 according to FIG. 3 operates as follows. A desired operating pressure is adjusted for the hammer by means of the control pressure valve 9. The valve 21 is adjusted to open at a lower pressure than the control pressure valve. By adjusting the opening force of the spindle 40 (parts 42, 41), a desired stroke frequency is searched for for the hammer in an easily-penetrated material. When such a resistance valve is used, the adjustment of the hammer according to the material to be broken does not depend significantly on the volume flow fed into the hammer.

After the adjustment of the maximum and minimum pressure according to the Finnish Patent Application 943074, i.e. a stepless adjustment, has been constructed in the control pressure valve, the return line resistance valve is adjusted to open at a pressure higher than said minimum pressure, but at a pressure lower than the maximum pressure. At the maximum pressure, the hammer is then always adjusted to the full length of stroke and provides full impact energy, and at the minimum pressure, it is always adjusted to a shorter length of stroke and provides a low impact energy, but a high stroke frequency.

The invention naturally comprises such a return flow resistance valve the opening of which has been arranged simultaneously by the pressure of the high-pressure circuit and by the pressure of the return flow.

I claim:

1. Hydraulic percussion hammer, comprising a percussion piston having two pressure surfaces, a pressure accumulator, an inlet duct for supplying the percussion hammer with pressure fluid, a return duct for leading the pressure fluid out of the percussion hammer, a main valve connected to guide a high pressure and a low pressure to act alternately at least on one pressure surface of the percussion piston for reciprocating the percussion piston for an impact and a control pressure valve being in contact with the inlet duct, driven by the pressure therein and connected to control the main valve during a return motion of the percussion piston in such a way that the control pressure valve allows an access of the control pressure to the main valve when the pressure acting on the control pressure valve exceeds a predetermined value, wherein the hammer comprises a controller mounted in the return duct of the pressure fluid, by which controller the outflow of the pressure fluid from the percussion hammer can be adjusted, whereby the filling rate of the pressure accumulator and thus the length of the return motion of the percussion piston are proportional to the flow resistance provided by the controller.

2. Hydraulic percussion hammer according to claim 1, wherein for a control of impact power and stroke frequency of the hammers, both the controller and the control pressure valve are adjustable.

3. Hydraulic percussion hammer according to claim 2, wherein the controller is controlled by pressure fluid in such a way that the controller comprises at least one pressure surface being in contact with the high-pressure duct of the pressure fluid and urging the controller toward an open condition.

4. Hydraulic percussion hammer according to claim 2, wherein a pressure fluid duct is connected to the control pressure valve, by which duct the opening pressure of the control pressure valve can be adjusted, and accordingly, the impact power of the percussion hammer can be adjusted.

5. Hydraulic percussion hammer according to claim 1, wherein the controller is controlled by pressure fluid in such a way that the controller comprises at least one pressure surface being in contact with the high-pressure duct of the pressure fluid and urging the controller toward an open condition.

6. Hydraulic percussion hammer according to claim 5, wherein a pressure fluid duct is connected to the control pressure valve, by which duct the opening pressure of the control pressure valve can be adjusted, and accordingly, the impact power of the percussion hammer can be adjusted.

7. Hydraulic percussion hammer according to claim 1, wherein a pressure fluid duct is connected to the control pressure valve, by which duct the opening pressure of the control pressure valve can be adjusted, and accordingly, the impact power of the percussion hammer can be adjusted.

* * * * *